US009134032B2

(12) United States Patent
Flynn et al.

(10) Patent No.: US 9,134,032 B2
(45) Date of Patent: Sep. 15, 2015

(54) ARTIFICIAL FIREPLACE

(71) Applicant: Basic Holdings, Cloghran, Dublin (IE)

(72) Inventors: Muiris Flynn, Navan (IE); John Prendergast, Clogherhead (IE); Dirk Jan Jacob Mus, Amsterdam (NL)

(73) Assignee: Basic Holdings, Cloghran, Dublin (IE)

( * ) Notice: Subject to any disclaimer, the term of this patent is extended or adjusted under 35 U.S.C. 154(b) by 0 days.

(21) Appl. No.: 14/374,377

(22) PCT Filed: Jan. 23, 2013

(86) PCT No.: PCT/EP2013/051263
§ 371 (c)(1),
(2) Date: Jul. 24, 2014

(87) PCT Pub. No.: WO2013/110674
PCT Pub. Date: Aug. 1, 2013

(65) Prior Publication Data

US 2014/0373406 A1 Dec. 25, 2014

(30) Foreign Application Priority Data

Jan. 24, 2012 (NL) ..... N2008170
Jun. 8, 2012 (GB) ..... 1210108.5

(51) Int. Cl.
*G09F 19/00* (2006.01)
*F24B 1/18* (2006.01)
*F24C 7/00* (2006.01)
*F21S 10/04* (2006.01)

(52) U.S. Cl.
CPC ..... *F24B 1/1808* (2013.01); *F21S 10/04* (2013.01); *F24C 7/004* (2013.01)

(58) Field of Classification Search
CPC ..... G09F 19/12; G09F 13/30; F24C 7/004; F24C 3/006; F21S 10/04
USPC ..... 40/428
See application file for complete search history.

(56) References Cited

U.S. PATENT DOCUMENTS

| | | | | |
|---|---|---|---|---|
| 5,642,580 | A * | 7/1997 | Hess et al. | 40/428 |
| 6,050,011 | A * | 4/2000 | Hess et al. | 40/428 |
| 6,393,207 | B1 * | 5/2002 | Martin et al. | 392/348 |
| 6,615,519 | B2 * | 9/2003 | Hess | 40/428 |
| 6,880,275 | B2 * | 4/2005 | Mix et al. | 40/428 |
| 6,944,982 | B2 * | 9/2005 | Schroeter et al. | 40/428 |
| 7,134,229 | B2 * | 11/2006 | Hess et al. | 40/428 |
| 7,334,360 | B1 * | 2/2008 | Corry et al. | 40/428 |
| 8,739,439 | B2 * | 6/2014 | Asofsky et al. | 40/428 |
| 2003/0126775 | A1 * | 7/2003 | Corry et al. | 40/428 |
| 2005/0097792 | A1 * | 5/2005 | Naden | 40/428 |
| 2006/0162198 | A1 * | 7/2006 | Hess et al. | 40/428 |

(Continued)

FOREIGN PATENT DOCUMENTS

| | | | |
|---|---|---|---|
| EP | 1 020 685 | 7/2000 | F24C 7/00 |
| EP | 1 271 060 | 1/2003 | F24C 7/00 |

(Continued)

OTHER PUBLICATIONS

International Search Report and Written Opinion for International Application No. PCT/EP2013/051263, Aug. 21, 2013.

*Primary Examiner* — Shin Kim
(74) *Attorney, Agent, or Firm* — Kusner & Jaffe

(57) ABSTRACT

An artificial fireplace comprising a screen and a fuel bed portion. An optical element is provided which is configured to transpose an image of one of the screen and fuel bed to create the impression of a burning fire.

20 Claims, 3 Drawing Sheets

(56) References Cited

U.S. PATENT DOCUMENTS

| | | | | |
|---|---|---|---|---|
| 2006/0213097 | A1* | 9/2006 | Haugom | 40/428 |
| 2007/0094903 | A1* | 5/2007 | Hess et al. | 40/428 |
| 2007/0107279 | A1* | 5/2007 | Wei et al. | 40/428 |
| 2007/0107280 | A1* | 5/2007 | Stinson et al. | 40/428 |
| 2011/0299283 | A1* | 12/2011 | Gallo et al. | 362/282 |
| 2014/0373406 | A1* | 12/2014 | Flynn et al. | 40/428 |

FOREIGN PATENT DOCUMENTS

| | | | |
|---|---|---|---|
| GB | 397995 | 9/1933 | F24C 7/00 |
| GB | 2 438 942 | 12/2007 | F24C 7/00 |
| GB | 2 444 073 | 5/2008 | F24C 7/00 |
| GB | 2 466 434 | 6/2010 | F24C 7/00 |
| GB | 2 467 297 | 7/2010 | F24C 7/00 |
| WO | WO 2008/033949 | 3/2008 | H04N 5/44 |

* cited by examiner

ARTIFICIAL FIREPLACE

FIELD OF THE INVENTION

The invention relates to an artificial fireplace for giving an impression of a burning fire such as for example a wood fire or glowing stones.

BACKGROUND

Artificial fireplaces are known. Such a fireplace is known for example from practice and is embodied with lights and artificial wood or glowing stones wherein the stones are most of the time white. The light interacts with the wood or stones to provide an impression of their glowing. Artificial fireplaces have numerous advantages in comparison with real fireplaces. In comparison with real fireplaces, artificial fireplaces are intended to be safe, energy-efficient, avoiding the need to use actual woodblocks, avoid chimneys, be clean, reliable and maintenance free, are easy to place and apply in a variety of circumstances, have little or operating expenses, be free from residual heat, are environmentally healthy in terms of a lack of carbon dioxide and fine dust. When of proper design artificial fireplaces have no impact on insurance requirements, and can be easily traded in other countries having different regulations.

There are continued efforts to provide such artificial fireplaces and the present teaching aims to address the problem of how to provide such an improved artificial fireplace which simulate one or more of flame and fuel effects.

SUMMARY

Accordingly the present teaching provides an artificial fireplace as detailed in the independent claims. Advantageous features are provided in the dependent claims.

In a first aspect the present teaching provides an artificial fireplace which incorporates a dichroic mirror. An imaging means is placed in the line of sight of the viewer and behind the dichroic mirror. A means for showing an image of the background is placed in front of the dichroic mirror and configured such that the background image is reflected by the mirror into the line of sight of the viewer. With this interchanging of the position of the means for showing an image of the background and the imaging means, a vast improvement over known artificial fireplaces is achieved. The fireplace is provided in a housing or box and using such a configuration the box requires less depth and it is possible to accommodate greater viewing angles of the generated artificial flames. It is also possible using such a configuration to provide in a more natural way woodblocks or stones or other fuel effect means that are provided in front of the generated flames.

The imaging means may be provided using a number of technologies or elements. For example, the imaging means may comprise a monitor or a 3-D monitor. In one configuration where such a monitor is used, a mask is provided between the imaging means and the dichroic mirror. The mask has a form such that regions at its periphery provide diminished translucency relative to the centre regions of the mask. In this way a gradual transition between a complete dark inner part of the box and an open or translucent port that provides a viewer with an image of the artificial fire is provided. This non-regular optical transparency across the planar surface of the mask can be configured to optimise the generated artificial flame effect.

The benefits of the present teaching are many. In one optimal configuration, the means for providing the background image or picture is provided in an upper region of the box so as to provide a view at an image of the background in the line of sight of the viewer by reflecting said background image by the dichroic mirror.

Another beneficial feature derives from the use within the context of the present teaching of real-life objects which are viewable within the light of sight of the viewer as reflected by the dichroic mirror and/or as seen through the dichroic mirror. This promotes a natural overall impression of an active wood or other fuel effect fire, or indeed of glowing stones where this material is used.

It is further beneficial that the housing or box has one or more light sources to provide internal illumination such as may be usefully employed in illumination of the real-life objects. This can be usefully employed for active illumination of the fuel bed elements so as for example to provide an effect of glowing embers.

Still another beneficial feature derives from the use of at least one of the light sources arranged to provide light shining through an open or translucent port out of the box. This can be usefully employed to enhance the effect that one would expect from light emanating from a real wood fire or from glowing stones or other fuel effect elements.

Another aspect of the present teaching is the provision of a control system which is connected to the light sources. This allows the light sources to vary in accordance with the control provided by the control system. This can be provided for example synchronously with the flames shown or presented by the imaging means and thus the two can in combination simulate the effect that one would expect from a real burning fire.

The realism of the fire can be further enhanced by provision of audio means, preferably controlled by the control system, and arranged to provide an output which is consistent with what would be expected as the acoustic impression of a burning fire.

The present teaching will be further elucidated with reference to exemplary arrangements but it will be appreciated that these are provided to assist in an understanding of the present teaching and it is not intended to explicitly limit the teaching to that described.

DETAILED DESCRIPTION OF THE INVENTION

Figure 1:
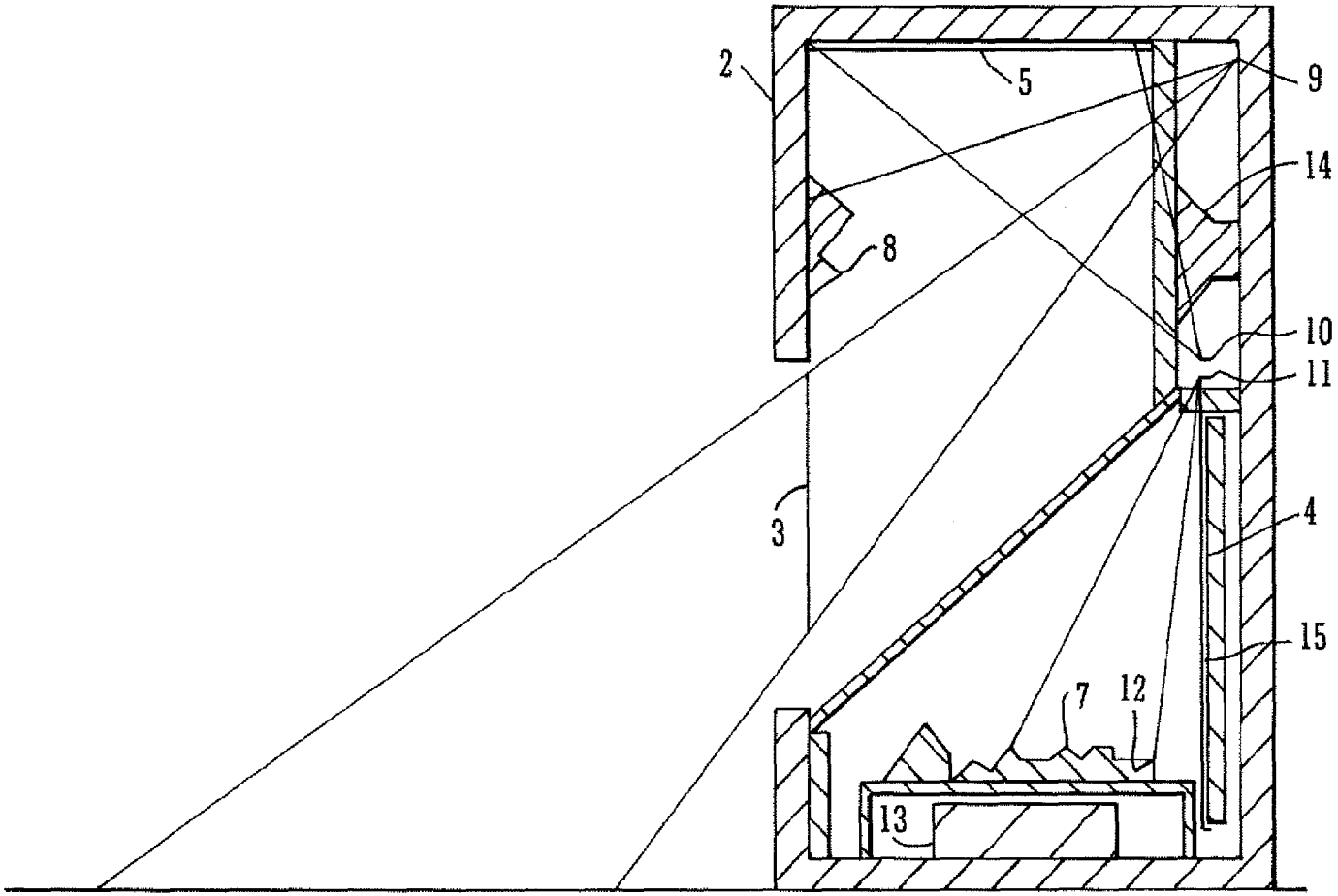
FIG. 1 shows a cross section as seen from the side of an artificial fireplace in accordance with the present teaching

In FIG. 1, the artificial fireplace 1 is shown to comprise a box 2 having an open or translucent port 3 providing a viewer (a person) with a line of sight into the box 2. The box 2 comprises, in combination, imaging means 4 for showing flames, means 5 for showing a background picture or image, and a dichroic mirror 6 for merging the background picture with the flames to provide the viewer with the impression of a burning fire—in this example a burning wood fire. As the figure shows, the imaging means 4 for the flames is provided in the line of sight of the viewer so as to be disposed behind the dichroic mirror 6. The means 5 for showing the background image is provided in front of and above the mirror 6 such that it is reflected by the mirror 6 though the open or translucent port 3 into the line of sight of the viewer. The imaging means can be any suitable device, but preferably is a monitor or a 3-D monitor. It is preferably provided having a flat panel form so as to minimize the depth of the overall apparatus.

Preferably between the imaging means 4 for the flames and the dichroic mirror 6 is provided a mask 15. The mask is configured to have diminishing translucency at its outer periphery in comparison with its central part.

As already mentioned and shown in the Figure, the means 5 for showing the background picture is provided in an upper part of the box 2 so as to provide a view of the background picture by reflecting said background picture by the dichroic mirror 6 in the line of sight of the viewer through the open or translucent port 3.

It is further remarked that the box 2 preferably has real-life objects 7, 8 that are viewable in the line of sight of a viewer as reflected by the dichroic mirror 6 (object 8) and/or as seen through the dichroic mirror 6 (object 7).

The figure shows a first embodiment in which the box 2 has one or more light sources 9, 10, 11, 12 to inter alia illuminate the real-life objects 7, 8 to make them visible through the dichroic mirror 6 or by reflection by the dichroic mirror 6. Object 7 is illuminated on the outside by light source 11. Objet 8 is illuminated by light sources 9 and 10. It is further shown that light source 9 provides light shining through the open or translucent port 3 out of the box 2. The figure further shows a control system 13 to which the light source 9, 10, 11, 12 are connected to improve the overall impression of an active fire, in this example a wood fire, by varying the amount of light that said light sources provide. Finally it is remarked that it is preferable that the box 2 comprises means for providing an acoustic impression of an active fire—this is symbolized by the speaker 14.

Figure 2:
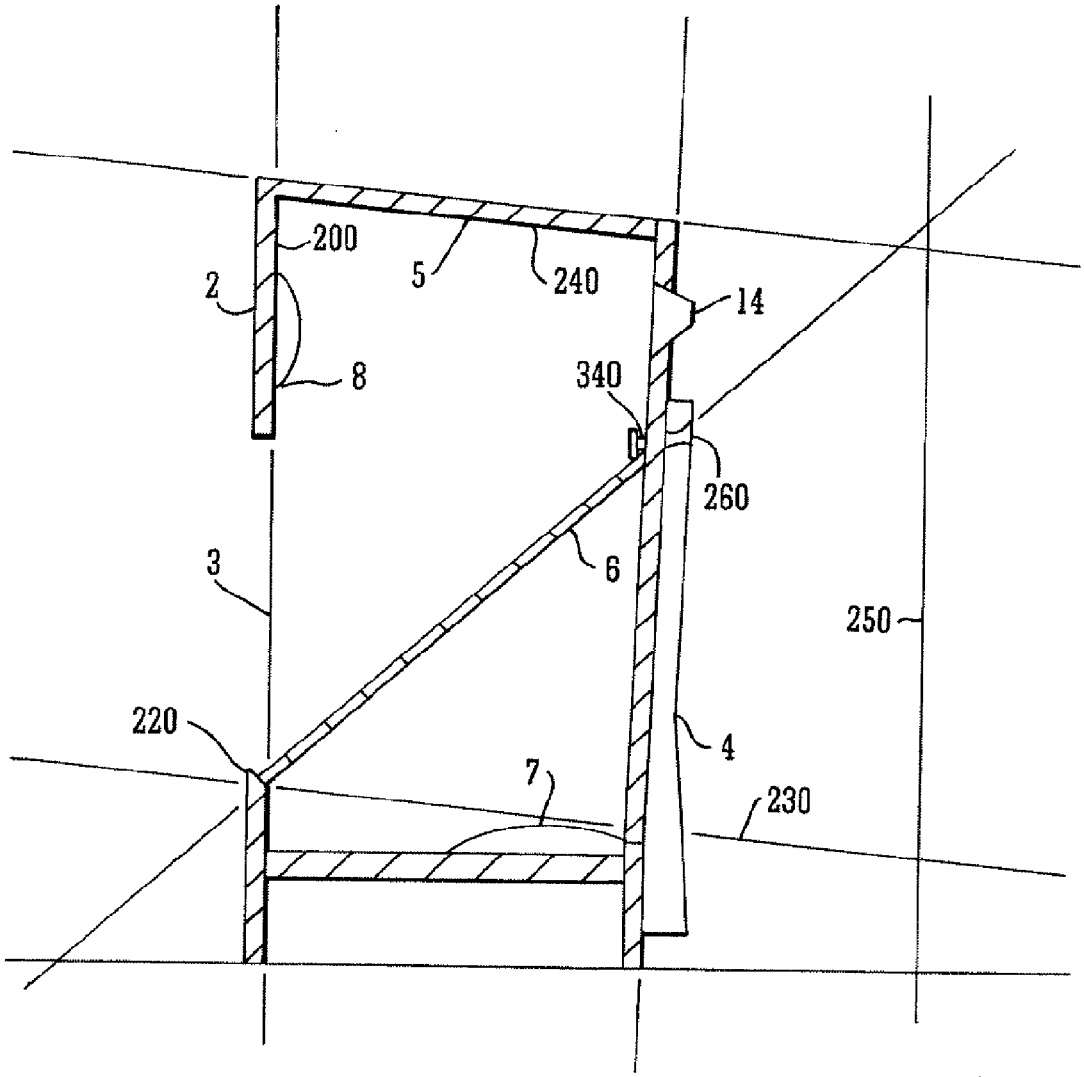
FIG. 2 is an example of another arrangement of an artificial fireplace in accordance with the present teaching.

FIG. 2 shows another example of an artificial fireplace in accordance with the present teaching. The same reference numerals will be used to describe components or elements already described with reference to FIG. 1. As is shown in this configuration, the fireplace comprises a housing 2 having an optical element 6 provided therein. A first fuel bed portion 8 is mounted vertically within the housing. In this configuration the fuel bed portion 8 is provided on an inner surface 200 of the housing. In this way a viewer to the front of the fireplace and looking through the viewing port 3 would not normally see the fuel bed portion 8. The optical element extends upwardly and inwardly from a lower portion 220 of the viewing port towards the rear 260 of the housing. In this configuration the optical element is orientated at an angle of about 42 degrees relative to the horizontal. The actual orientation may vary, typically between about 35 degrees to about 50 degrees to the horizontal.

A vertically orientated screen 4 is provided for displaying flame images. In this configuration the screen 4 and fuel bed element 8 are parallel with one another. The optical element is configured to transpose an image of the first fuel bed portion to a substantially horizontal location adjacent to the screen. This virtual image is shown in FIG. 2 by the dashed line 230 and creates a virtual fuel bed co-located with the screen so as to provide a user with an impression of a burning fire emanating from the fuel bed. The virtual fuel bed 230 thus created is located to the rear of the screen 4. By providing a second fuel bed portion 7 located forwardly of the screen, the images of burning flames that are provided on the screen 4 appear to originate from within a larger fuel bed created by the visual impression caused by the combination of the physical fuel bed 7 and the virtual fuel bed 230.

The nature of the materials used to generate the first and second fuel bed portions 7,8 may be the same, or different. In this example, the first fuel bed portion 8 is fabricated to resemble logs and the second fuel bed portion 7 is fabricated to resemble coals. It will be appreciated that this may be varied dependent on the desired optical or visual effect.

A background image 5 may also be provided. In this arrangement and similar to that described with reference to FIG. 1, the background image is provided in an upper region of the housing 2. In this configuration the background image 5 is provided on an upper substantially horizontal surface 240 of the housing. As will be seen from FIG. 2, the orientation of this surface is not completely horizontal—and as such differs from the example of FIG. 1—and is actually at an angle of about 6 degrees relative to the horizontal. Similarly to how the optical element reflects the fuel bed portion 8 to create a vertical image behind the screen 4, the background image is also reflected to be located behind and visible through the screen 4. As is seen in FIG. 2, it appears to be located in a vertical plane 250 substantially parallel with the orientation of the screen 4.

The configuration of FIG. 2 is well suited to be wall hung as it provides a slim-line fire of limited depth.

Figure 3:
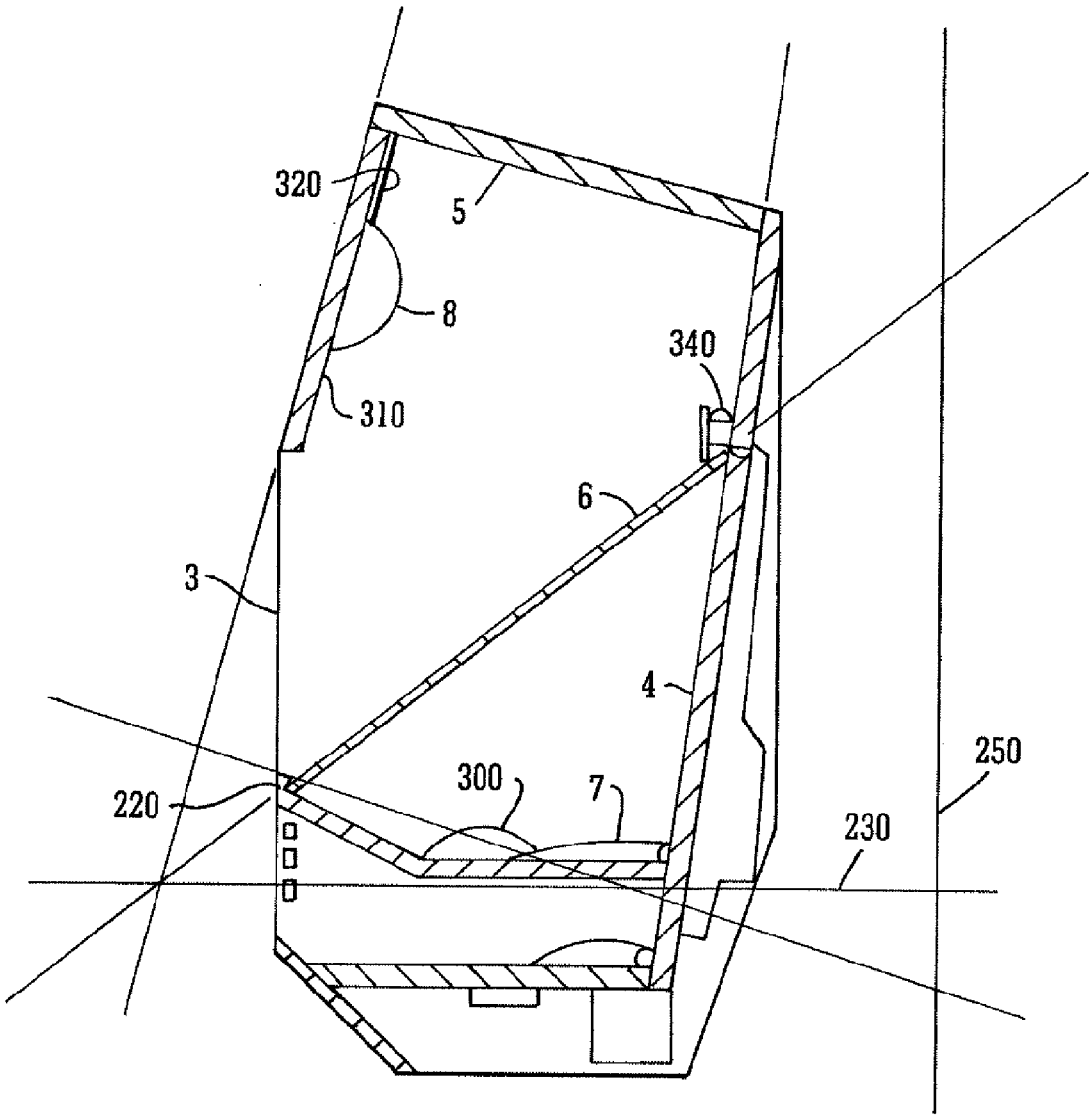
FIG. 3 is an example of another arrangement of an artificial fireplace in accordance with the present teaching.

In another configuration shown in FIG. 3, an example that may be usefully deployed in a stove configuration is shown. It will be understood that such a stove configuration is a self-standing apparatus which does not require mounting to a wall or other support structure. Again, the same reference numerals will be used for similar components. In this configuration, in addition to the first and second fuel bed portions 7, 8 a third fuel bed portion 300 is provided. This fuel bed portion is provided forwardly of the second fuel bed portion 7 and arranged in a lower portion of the housing. The reflection of the first fuel bed portion 8 onto the plane 230 creates a perceived deep fuel bed extending from the third fuel bed portion 300 through the second fuel bed portion 7 to the virtual first fuel bed portion 230. The screen 4 which again is substantially vertically orientated within the housing, appears to a viewer to the front of the housing to be located in the middle of the fuel bed thereby enhancing the effect of the artificial fireplace.

In this configuration, the first fuel bed 8 is again located in an upper region of the housing. In this arrangement however, while it is still angularly offset from the second fuel bed portion 7, it is not perpendicular. Within this context and any reference to perpendicular it will be appreciated that exemplary arrangements may require the first and second fuel bed portions to be substantially perpendicular but this does not have to be considered as being constrained to specifically 90 degrees offset from one another. For example angularly offset in the range 70 to 110 degrees may suffice. 80 to 100 degrees separation may be beneficial and 90 degrees separation would represent a further limitation.

In this example the surface 310 on which it is mounted is angularly oriented about 14 degrees rearwardly. A mirror 320 is located on that surface 310 between the first fuel bed 8 and the background image 5 and serves, in use, to reflect the background image downwardly so as to enlarge the ultimate illusion of the created virtual background 250. One or more LED's or other lights 340 are arranged within the housing and provide internal illumination of one or more components or elements within the housing. The LEDs may be provided in a strip lighting effect. Suitable locations for such LED strips include:

1) A red led strip under the second fuel bed portion 7

2) A warm white led strip shining down on the third fuel bed portion 300 in front of the monitor 4.

3) A warm white LED strip shining up to the background 5 and first fuel bed portion 8.

It will be appreciated that the examples of the artificial fireplace described herein are exemplary of the type of arrangement that may be employed within the context of the present teaching. By using an optical element to create a virtual representation of a fire element, it is possible to create the illusion of a fire within a relatively compact housing.

It will be appreciated that the present teaching is not restricted to the exemplary arrangement as discussed with reference to the Figures. There may be numerous modifications in the form of options added or options deleted without departing from the essence of the present teaching. The scope of protection that merits the present teaching is therefore determined only by reference to the appended claims whereas the above exemplary teaching is provided to clarify any possible ambiguity and to assist in an understanding of the instant teaching.

Having described the invention, the following is claimed:

1. Artificial fireplace for giving the impression of a burning fire, comprising a box having an open or translucent port providing a viewer with a line of sight into the box, the box comprising:

fuel bed elements provided in first and second portions, the first and second portions being substantially perpendicular to one another;

imaging means for displaying an image of flames;

a background image; and a dichroic mirror for merging the image of the flames with at least one of (i) the background image and (ii) at least one of the fuel bed elements, so as to provide a user with an impression of a burning fire.

2. The fireplace of claim 1 wherein the imaging means is provided within the box so as to be in the line of sight of the viewer and behind the dichroic mirror.

3. The fireplace of claim 1 wherein the background image is provided within the box and in front of the dichroic mirror such that the background image is reflected by the mirror into the line of sight of the viewer.

4. The fireplace of claim 1 wherein the imaging means is an active display.

5. The fireplace of claim 1 wherein the imaging means is a monitor or a 3-D monitor.

6. The fireplace of claim 1 comprising a mask disposed between the imaging means and the dichroic mirror.

7. The fireplace of claim 6 wherein the mask is configured to have a region of diminishing translucency at its outer periphery relative to its central part.

8. The fireplace of claim 1 wherein the background image is provided in an upper region of the box out of the line of sight of the viewer.

9. The fireplace of claim 1 wherein the background image is provided above the dichroic mirror, the mirror reflecting the background image into the line of sight of a viewer.

10. The fireplace of claim 1 wherein the first portion of fuel bed elements is provided in front of the mirror and the second portion of fuel bed elements is provided behind the mirror, the mirror merging the first and second portions to create an optical illusion of a single fuel bed.

11. The fireplace of claim 1 wherein the first portion is provided in an upper region of the box.

12. The fireplace of claim 1 wherein the first portion is provided on an inner surface of the box.

13. The fireplace of claim 12 wherein the inner surface is a vertical surface of the box.

14. The fireplace of claim 1 wherein the second portion is provided in a lower portion of the box.

15. The fireplace of claim 14 wherein the second portion is horizontally mounted within the box.

16. The fireplace of claim 1 comprising one or more light sources configured to illuminate one or more regions of the fuel bed elements.

17. The fireplace of claim 16 wherein the one or more light sources are arranged to provide light shining through the open or translucent port out of the box.

18. The fireplace of claim 16 comprising a control system coupled to the one or more light sources and arranged to selectively activate the one or more light sources.

19. The fireplace of claim 1 wherein the fuel bed elements comprise one or more of pebbles, wood elements, coal elements.

20. The fireplace of claim 1 comprising acoustic means configured for providing an acoustic impression of an active fire.

* * * * *